US008907211B2

(12) United States Patent
Fox et al.

(10) Patent No.: US 8,907,211 B2
(45) Date of Patent: Dec. 9, 2014

(54) POWER CABLE WITH TWISTED AND UNTWISTED WIRES TO REDUCE GROUND LOOP VOLTAGES

(76) Inventors: Jamie M. Fox, Martinez, CA (US); William E. Whitlock, Oxnard, CA (US)

( * ) Notice: Subject to any disclaimer, the term of this patent is extended or adjusted under 35 U.S.C. 154(b) by 396 days.

(21) Appl. No.: 13/283,520

(22) Filed: Oct. 27, 2011

(65) Prior Publication Data

US 2012/0103646 A1 May 3, 2012

Related U.S. Application Data

(60) Provisional application No. 61/407,991, filed on Oct. 29, 2010.

(51) Int. Cl.

| | |
|---|---|
| ***H01B 7/00*** | (2006.01) |
| ***H01B 9/02*** | (2006.01) |
| ***H01B 11/02*** | (2006.01) |
| *H01B 11/00* | (2006.01) |
| *H01B 11/04* | (2006.01) |
| *H01B 13/02* | (2006.01) |

(52) U.S. Cl.

CPC ..... *H01B 9/028* (2013.01); *H01B 11/02* (2013.01); *H01B 11/00* (2013.01); *H01B 11/04* (2013.01); *H01B 13/02* (2013.01)

USPC ..... 174/27; 174/33; 174/110 R; 174/113 R

(58) Field of Classification Search

CPC ..... H01B 11/04; H01B 11/02; H01B 7/00; H01B 7/306; H01B 7/0876

USPC ..... 174/28, 36, 110 R, 113 R, 117 R, 117 F, 174/117 FF, 120 R

See application file for complete search history.

(56) References Cited

U.S. PATENT DOCUMENTS

| | | | | | |
|---|---|---|---|---|---|
| 995,588 | A | * | 6/1911 | Cuntz | 379/415 |
| 3,502,791 | A | | 3/1970 | Dahlstrom | |
| 3,829,603 | A | | 8/1974 | Hansen et al. | |
| 4,012,577 | A | | 3/1977 | Lang et al. | |
| 4,208,542 | A | * | 6/1980 | Endo | 174/113 C |
| 4,404,424 | A | | 9/1983 | King et al. | |
| 4,506,235 | A | | 3/1985 | Mayer | |
| 4,777,325 | A | | 10/1988 | Siwinski | |
| 5,110,999 | A | | 5/1992 | Barbera | |
| 5,266,744 | A | * | 11/1993 | Fitzmaurice | 174/103 |
| 5,313,020 | A | | 5/1994 | Sackett | |
| 5,329,064 | A | * | 7/1994 | Tash et al. | 174/36 |
| 5,329,065 | A | * | 7/1994 | Marney et al. | 174/128.1 |
| 5,521,007 | A | | 5/1996 | Kurokawa | |

(Continued)

FOREIGN PATENT DOCUMENTS

| | | | | | |
|---|---|---|---|---|---|
| JP | 10-12055 | A | * | 1/1998 | H01B 11/08 |
| JP | 2003-242840 | A | * | 8/2003 | H01B 11/08 |

*Primary Examiner* — William H Mayo, III

(74) *Attorney, Agent, or Firm* — Temmerman Law Office; Mathew J. Temmerman

(57) ABSTRACT

An improved power cable having an untwisted ground wire and at least two current carrying wires twisted about one another. The at least two current carrying wires make up a group having a central axis located at the cross sectional rotation axis of the current carrying wires and at a fixed distance from a cross sectional center of the untwisted ground wire, and wherein the current carrying wire group central axis and a ground wire central axis helically rotate around a common axis.

29 Claims, 10 Drawing Sheets

(56) References Cited

U.S. PATENT DOCUMENTS

| | | | | |
|---|---|---|---|---|
| D374,649 | S | 10/1996 | Choi | |
| 5,606,151 | A | 2/1997 | Siekierka et al. | |
| 5,767,441 | A | 6/1998 | Brorein et al. | |
| 5,777,273 | A | 7/1998 | Woody et al. | |
| 5,831,210 | A * | 11/1998 | Nugent | 174/27 |
| 5,864,094 | A | 1/1999 | Griffin | |
| 5,930,310 | A | 7/1999 | Freeman | |
| 5,969,295 | A | 10/1999 | Boucino et al. | |
| 6,066,799 | A | 5/2000 | Nugent | |
| 6,242,689 | B1 * | 6/2001 | Budge | 174/27 |
| D449,582 | S | 10/2001 | Nakashima et al. | |
| 6,355,876 | B1 | 3/2002 | Morimoto | |
| 6,370,769 | B1 | 4/2002 | Lilienthal, II | |
| 6,388,188 | B1 * | 5/2002 | Harrison | 174/27 |
| 6,448,500 | B1 | 9/2002 | Hosaka et al. | |
| 6,486,395 | B1 * | 11/2002 | Temblador | 174/36 |
| 6,664,466 | B2 | 12/2003 | Bailey | |
| 6,703,558 | B2 | 3/2004 | Uang | |
| 6,734,362 | B2 | 5/2004 | Buck et al. | |
| 6,740,808 | B1 | 5/2004 | Chang | |
| 6,787,694 | B1 | 9/2004 | Vexler et al. | |
| 6,867,362 | B2 | 3/2005 | Chernisky et al. | |
| 6,888,070 | B1 | 5/2005 | Prescott | |
| 6,998,538 | B1 | 2/2006 | Fetterolf, Sr. et al. | |
| 7,012,496 | B2 | 3/2006 | Sugiura et al. | |
| 7,220,919 | B2 | 5/2007 | Kenny et al. | |
| 7,342,172 | B1 | 3/2008 | Wang et al. | |
| 7,449,638 | B2 | 11/2008 | Clark et al. | |
| 7,514,632 | B2 | 4/2009 | Lin | |
| 7,763,805 | B2 | 7/2010 | Stutzman | |
| 2001/0002773 | A1 | 6/2001 | Hyogo | |
| 2001/0013418 | A1 | 8/2001 | Donner et al. | |
| 2004/0055781 | A1 | 3/2004 | Cornibert et al. | |
| 2004/0112628 | A1 * | 6/2004 | Brandi et al. | 174/113 R |
| 2004/0264712 | A1 | 12/2004 | Lace | |
| 2005/0006126 | A1 * | 1/2005 | Aisenbrey | 174/68.1 |
| 2005/0045367 | A1 | 3/2005 | Somers et al. | |
| 2006/0105616 | A1 | 5/2006 | Fisher et al. | |
| 2008/0164049 | A1 * | 7/2008 | Vexler et al. | 174/113 R |
| 2008/0251276 | A1 | 10/2008 | Clark et al. | |
| 2008/0303604 | A1 | 12/2008 | Ao | |
| 2010/0200267 | A1 | 8/2010 | Baeck et al. | |
| 2010/0307811 | A1 | 12/2010 | Griffin | |
| 2012/0103652 | A1 * | 5/2012 | Ooyama et al. | 174/105 R |

* cited by examiner

POWER CABLE WITH TWISTED AND UNTWISTED WIRES TO REDUCE GROUND LOOP VOLTAGES

RELATED APPLICATION

This application claims priority from U.S. provisional application with Ser. No. 61/407,991, and which was filed on Oct. 29, 2011. The disclosure of the provisional application is incorporated herein as if set out in full.

BACKGROUND

1. Field of the Invention

The present invention relates in general to electrical power cables, and more specifically to an improved electrical power cable designed to minimize magnetically induced voltages on the power cable's ground conductor.

2. Background of the Invention

Audio, video, telecommunication devices, and other signal processing equipment is commonly interconnected with low voltage wiring which is inherently sensitive to ground voltage differences between different pieces of electronic equipment. When such ground voltage differences are present, the grounds of the various pieces of equipment are no longer equipotential and, as a consequence, unintended currents flow on the interconnected signal system wiring, ultimately resulting in system noise, data errors, and loss of signal quality. This phenomenon is often referred to as "ground loop noise." One common source of such ground voltage differences between power outlets or between pieces of equipment is magnetically induced voltages in the ground conductor(s) caused by the current carrying conductors adjacent to the ground conductor(s) in the power cable.

If all power cables maintained perfectly even separation between the ground conductor(s) and each current carrying conductor, no magnetically induced voltages would be created. However, no currently produced power cable is capable of maintaining such perfect geometry, particularly if the power cable is used in a manner in which it must bend around corners or curves. Thus, all currently available power cables induce voltages in the ground conductor or conductors.

Hence, it can be seen, that there is a need for an improved electrical power cable that can minimize magnetically induced voltages on the power cable's ground conductor or ground conductors.

It is thus a first object of the present invention to provide an electrical power cable that minimizes magnetically induced voltages on the power cable's ground conductor or ground conductors.

It is a second object of the present invention to provide an electrical power cable which minimizes magnetically induced voltages on the power cable's ground conductor or ground conductors, and which may be manufactured with two, three, or more current carrying conductors.

Additional objects and advantages of the present invention will become obvious to the reader, and it is intended that these objects and advantages be within the scope of the present invention.

SUMMARY OF THE INVENTION

The present application presents a power cable that minimizes the ground voltage differences present between equipment power terminals relative to conventional power cables. The power cable comprises current carrying wires that are twisted together and located adjacent to at least one ground conductor. The twisting averages the distance from each current carrying wire to the ground wire or wires over the length of the power cable. Due to this arrangement, the magnetic fields, created by the current carrying wires, that impinge upon the ground conductor will have nearly equal and opposite magnetic flux vectors over the length of the power cable run, thereby minimizing the magnetically induced voltages on the ground wire(s). This reduction in induced voltages on the ground conductor(s) has the beneficial effect of reducing ground loop noise in a system of connected equipment.

BRIEF DESCRIPTION OF THE FIGURES

The foregoing aspects and many of the attendant advantages of the invention will become more readily appreciated as the same becomes better understood by reference to the following detailed description, when taken in conjunction with the accompanying drawings, wherein.

DETAILED DESCRIPTION OF THE INVENTION

Figure 1:
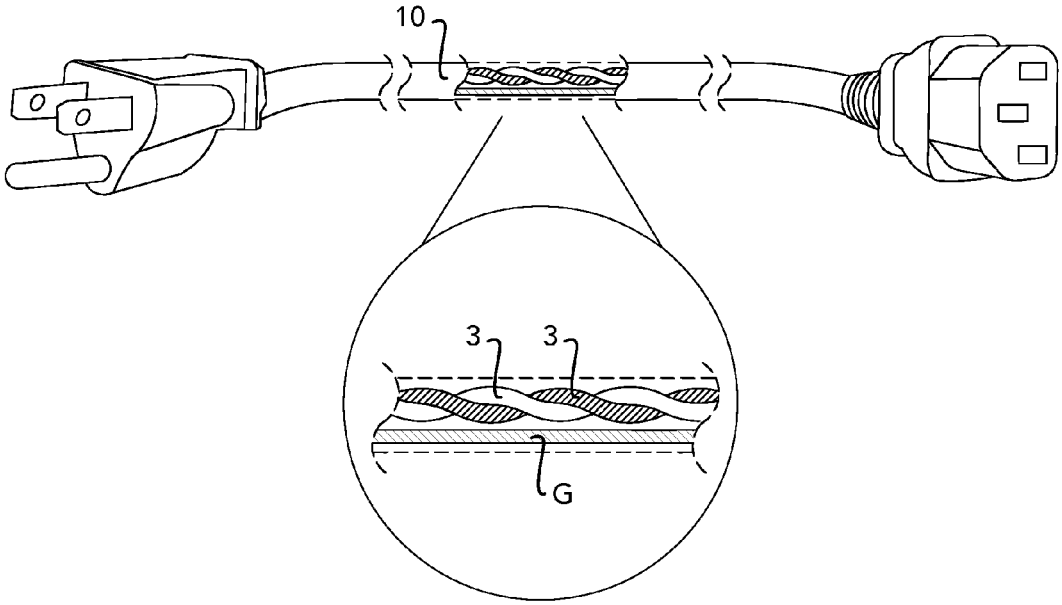
FIG. 1 is a perspective view of a preferred embodiment of the improved power cable, including a cut away section of the outer sheath to show the interior structure, also shown in enlarged format.

The improved power cable according to a preferred embodiment of the invention is a single assembly as shown in FIG. 1. The power cable 10 may deliver voltages ranging from 120 to 600 volts AC and supply from 15 to 750 amps. As is well known, attached equipment draws current based on the formula I=P/V, where (P) is the equipment power load, (V) is voltage at the equipment, and (I) is the current. For example, a 1,200-watt amplifier powered with 120 volts AC may draw 10 amps of current and may be protected by a 15 or 20 A branch circuit overcurrent device. The electrical current flows in equal and opposite directions on the two current carrying wires 3 (also called conductors or elongate conductors), referred to as "line" and "neutral" for 120V systems, and referred to as "line" and "line" for 208 or 240V single or three phase systems. The current carrying wires may be, but are not limited to, black and white in color.

A power cable's ground wire G (also called a ground conductor or ground elongate conductor) provides a safe pathway for fault currents if equipment or other malfunctions cause a short circuit in the system; therefore, the ground wire does not carry electrical currents exceeding 1 amp under normal operating conditions. In normal use, the ground wire typically carries a small amount of leakage current, typically around 10 mA or less. The ground wire also provides a common voltage reference point for signal processing equipment connected at various points within a power distribution system. If a voltage difference appears between the ground wires attached to various pieces of equipment then "noisy" currents will flow on the signal system wiring that interconnects the various pieces of equipment. This "noise" reduces the overall system performance. Interconnected systems that require very high signal-to-noise ratios, such as audio systems and laboratory systems, benefit greatly from reduced ground voltages between equipment.

Figure 10:
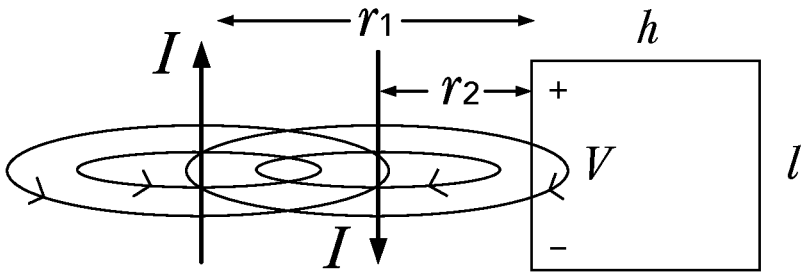
FIG. 10 shows the magnetic fields associated with two current carrying conductors with unequal proximity to a ground wire loop.

The theoretical basis for improved power cable presented herein is based on phenomenon discovered by Michael Faraday around 1839. Faraday's Law states that the induced voltage, or emf, in a wire loop is directly proportional to the rate of change of magnetic flux within the loop. Within a typical building a wire loop, or "ground loop" can be formed by the power cable's ground wire between two power outlets and a signal cable connecting various equipment plugged into the two power outlets. When current flows through the power cable's wires, a magnetic field is produced in a direction perpendicular to the direction of current flow. The strength of this magnetic field is related to the amount of current flowing and the distance from the current carrying wire. If a ground wire loop is located within proximity of two current carrying wires, a voltage will be induced on the ground wire due to magnetic induction according to the following equation (referenced to Whitlock Fox white paper: *Ground Loops the Rest of the Story*, available at http://www.aes.org/e-lib/browse.cfm?elib=15656, last accessed Oct. 22, 2011, and included as non patent literature with this application)

$$|\varepsilon loop| = -4\pi \times 10^{-7} lfI\left[\ln\left(\frac{r_2 + h}{r_2}\right) - \ln\left(\frac{r_1 + h}{r_1}\right)\right]$$

where: E is the induced voltage in the ground loop, l is the length of the ground wire loop parallel with the current carrying wires in meters, f is the frequency of the current in cycles per second, I is the magnitude of current flowing through the wires in Amps, r1 is the distance between the line wire and the ground wire in meters, r2 is the distance between the neutral wire and the ground wire in meters, and h is the length of the ground loop perpendicular to the current carrying wires (see FIG. 10).

Thus, according to the properties of magnetic induction, the voltage induced on the ground wire is a function of:

1. The length of the parallel run.
2. The frequency of the AC current (i.e. how fast the current changes with time).
3. The strength of the magnetic fields (which proportional to the amount of current flowing in the current carrying wires).
4. The difference in average distance from each current carrying wire to the ground loop.

Based on these properties of magnetic induction, a ground wire is subjected to varying amounts of induced voltage that depend on the physical arrangement of the wires within the power cable. The worst-case scenario for unwanted ground voltages is a long parallel run, with unequal and close proximity between the ground wire and the current carrying wires, and high frequency current. All of these factors that contribute to induced ground wire voltages are realized to some extent with conventional power cables currently available. As discussed above, as the internal geometry of conventional power cables is imperfect, especially when the cable must make bends or turns, conventional power cables are subject to induced voltages in their ground conductors. The presently presented power cable solves this problem by limiting the induced voltage to a maximum value within each twist length (e.g. pitch length) of the current carrying wire group relative to the center of the ground wire. The voltages induced with conventional power cable geometry may grow proportional to the entire length of the cable, leading to a significantly greater total voltage over the length of the power cable.

In FIG. 1, the preferred embodiment of the improved power cable is shown. The physical arrangement of the power cable with twisted current carrying wires running parallel with the ground wire will induce a voltage on the ground wire that grows and decays with each twist cycle of the current carrying wires, resulting in a periodic voltage waveform over the length of the ground wire.

The power cable assembly comprises two or more current carrying wires (e.g. at least one elongate line conductor and at least one elongate neutral conductor) that are twisted together at a twist rate cycle length greater than 2 and less than 2,000 times the outer diameter of each individual wire. Stated another way, the pitch of the twisted current carrying wires is greater than 2 but less than 2,000 times the outer diameter of each individual wire. In a preferred embodiment the current carrying wires, or elongate conductors, are helically wrapped or twisted. It is not practical to twist at cycle length rates below 2 times the diameter, and twist rate cycle lengths above 2,000 times the diameter do not provide adequate performance for most applications. For example, a cable with three #16 AWG size wires, each with a 0.05" outside diameter, may utilize a twist cycle length between 0.1" and 100". The ground wire or elongate ground conductor of the presently presented power cable is not twisted within the current carrying wire group; instead, it is separate from the twisted current carrying wires. The ground wire runs parallel to the central axis of the twisted current carrying wire group. The ground wire and the twisted current carrying wire group are both encased within a common cable assembly 10 comprising one or multiple layers of insulating and protective armor sheaths, as shown in a preferred embodiment in FIG. 1.

Figure 3:
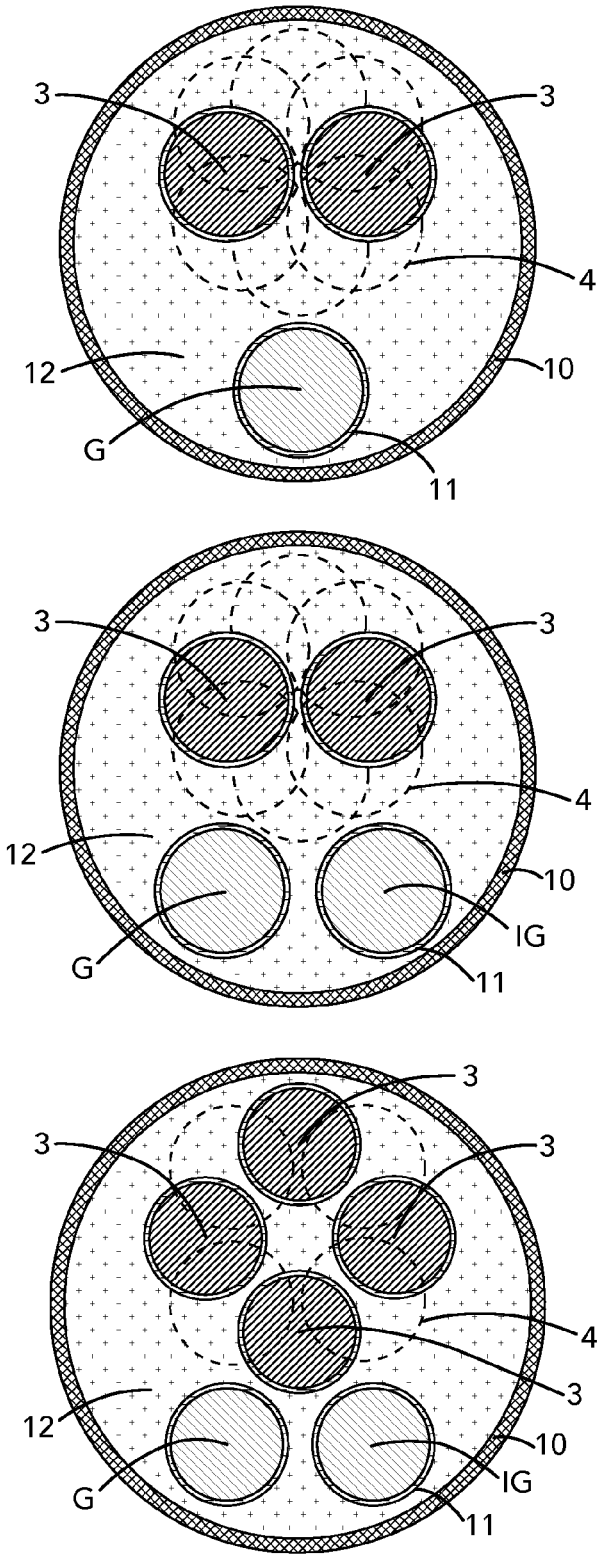
FIG. 3 depicts cross sections of various embodiments of the improved power cable; wherein, phantom lines represent diagrammatic cross sections taken at intervals behind the cross section.

Turning to FIG. 3, the outer diameter of the power cable will be slightly larger than conventional power cables because twisted wires require larger diameter enclosures than untwisted parallel wires. The power cable assembly may include non-conducting flexible material 12 to fill in the gaps created by the twisted pair, resulting in a power cable assembly that is circular when viewed in cross section. The power cable assembly may be configured to reduce the amount of fill material by utilizing an outer sheath that is asymmetrical and wraps tightly around the twisted current carrying wires and ground wire. Preferably each wire is coated with a layer of insulation 11 as known in the art.

The improved power cable may generally be thought of as comprising two sub-assembly groups within a common cable assembly. The first group is the twisted current carrying wires, the second group is the ground conductor or ground conductors running parallel to the twisted or helically wrapped current carrying wire group. As a result of this cable geometry, the distance from the midpoint of each ground conductor to the midpoint of each current carrying wire is averaged or equalized over each twist cycle of the current carrying wires relative to the ground conductor. By averaging the distance from each current carrying wire to the ground wire, the magnitude of the voltage induced on the ground wire cycles periodically with each twist cycle of the current carrying wires. This voltage cycling is a substantial improvement over conventional cables that may contain the ground conductor in parallel with the current carrying wires or twisted at the same rate as the current carrying wires for the entire length of the power cable. These conventional power cable arrangements may induce a voltage on the ground wire that grows at a rate proportional to the length of the power cable. The present invention induces voltages that grow and decay with each twist cycle of the current carrying wires, as opposed to continuously growing over the entire length of the cable. Therefore it can be seen that the magnitude of the voltage induced on the ground wire of the present invention is limited by the length of each twist cycle of the current carrying wire group. When the distance from each current carrying wire to the ground wire is equal and the value of the electrical currents in the current carrying wires are equal and opposite directions, the net magnetic flux within the ground wire loop will be zero. Therefore, induced voltages on the ground wire of the present invention will cycle periodically between maximum and minimum values with each twist cycle of the current carrying wires. Small accumulations of voltages due to imperfections within the present invention cable geometry may be considered negligible in comparison with the ground loop voltages resulting from the geometry of the prior art.

Another way to describe the physical arrangement of the wires or elongate conductors in the applicants' improved power cord is as follows: the helically wrapped or twisted current carrying elongate conductors (at least one line and at least one neutral, or at least two line conductors) have a first pitch, which is to say the length along the power cable in which the helically wrapped or twisted current carrying elongate conductors complete one twist cycle. Adjacent to the helically wrapped current carrying conductors is at least one ground conductor. The ground conductor may simply run parallel to the helically wrapped current carrying conductors or may be helically wrapped or twisted with the helically wrapped or twisted current carrying conductors at a second pitch. In either case, within each first pitch of power cord relative to the central axis of the elongate ground conductor, the average minimum distance between the central axis of the elongate ground conductor and the central axis of any one of the current carrying elongate conductors is equal to the average minimum distance between the central axis of the elongate ground conductor and the central axis of every other current carrying elongate conductor. It is also noted that the improved power cable must be at least one pitch long. This description remains true whether the ground conductor is parallel or wrapped/twisted with the wrapped/twisted current carrying conductors as long as the second pitch is less than the first pitch. Note that in order for the latter case to be true (ground conductor wrapped with the wrapped current carrying conductors) the minimum length of the power cable is one first pitch from the frame of reference of the ground conductor.

Figure 2A:
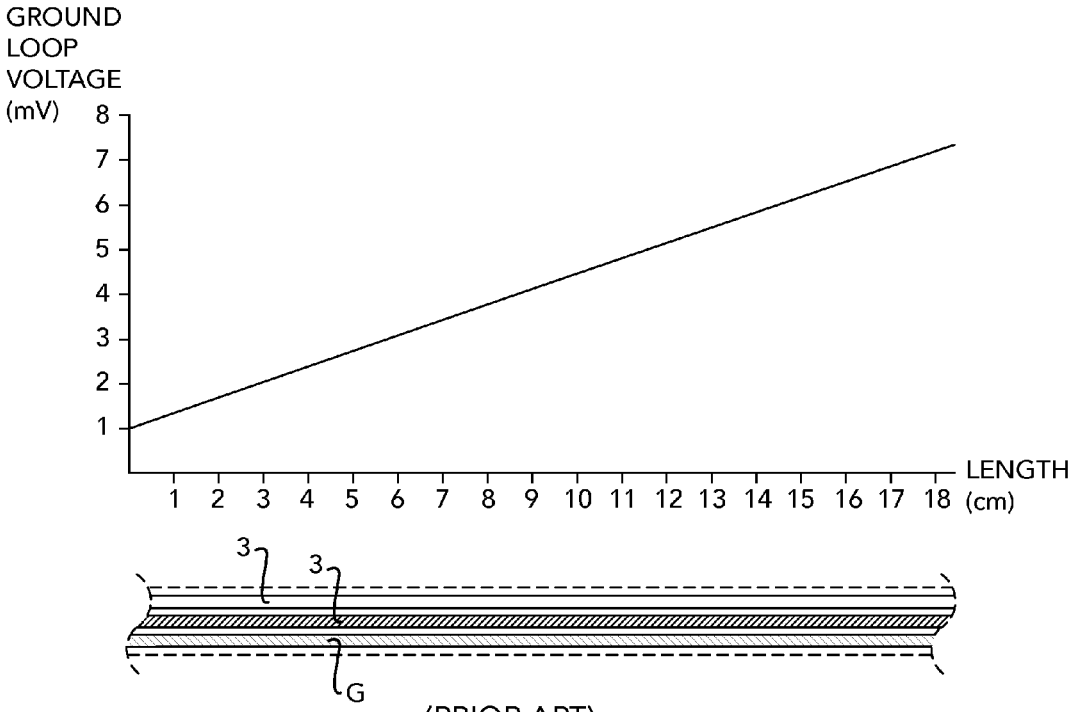
(PRIOR ART) FIG. 2A
FIG. 2 shows plots of ground loop voltage versus power cable length for conventional power cables and for the improved power cable according to its preferred embodiment.
Figure 2B:
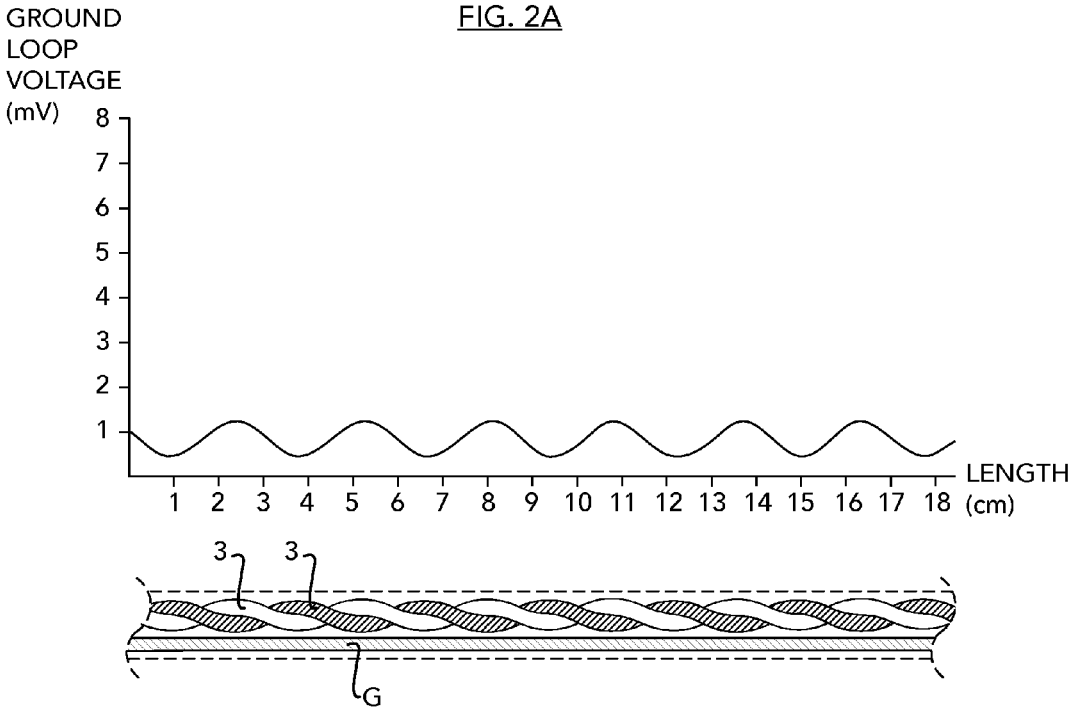

In FIG. 2, two illustrative plots of ground loop voltage at an arbitrary moment in time versus length of a power cable for a conventional power cable and for the applicants' improved power cable are shown. FIG. 2*a* shows the ground loop voltage for a conventional power cable. As may be seen in a conventional power cable the ground loop voltage can grow unchecked with power cable length. FIG. 2*b* shows the ground loop voltage for the improved power cable. As may be seen, the induced voltage is substantially lower because the voltage offsets itself with each twist cycle rather than growing unchecked with distance.

Figure 4A:
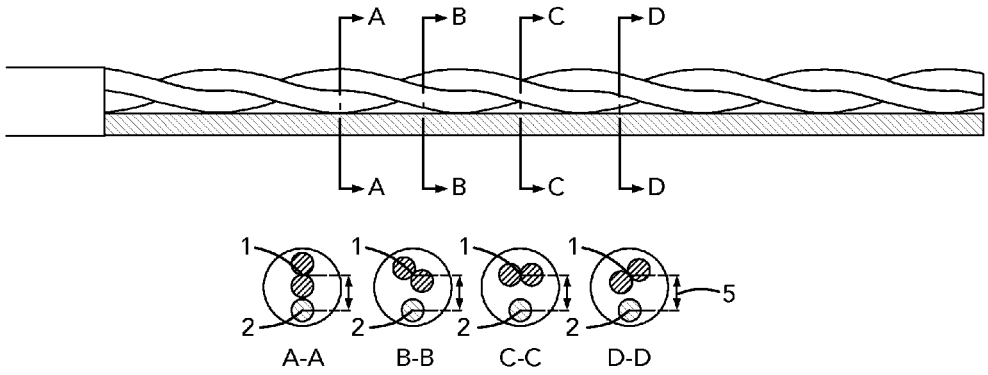
FIG. 4 depicts a preferred embodiment of the improved power cable in a side view and several cross sectional views along cut-lines A-A, B-B, C-C, and D-D (FIG. 4A), an end view relative to the ground wire (FIG. 4B), and a perspective view (FIG. 4C)
Figure 4B:
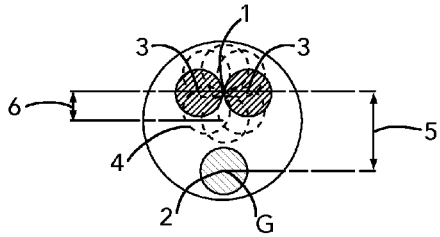
Figure 4C:
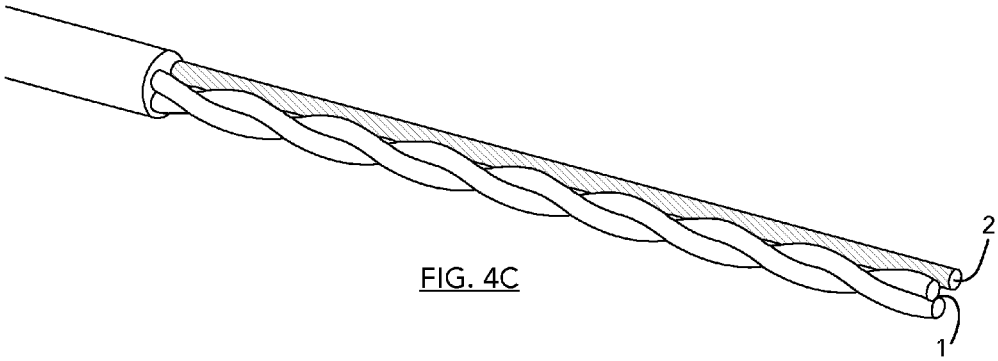

In FIG. 4, a preferred embodiment of the improved power cable is shown in a side view and several cross sectional views along cut-planes A-A, B-B, C-C, and D-D (FIG. 4A), an end view enlarged to show detail (FIG. 4B), and a perspective view (FIG. 4C). The power cable assembly comprises two discrete points of interest when viewed in cross section: The first point is the central axis 1 of the twisted current carrying wires, the second is the midpoint of the ground wire 2. These two points generally remain in static separation as they run in parallel or are helically rotated around the central axis (not labeled) of the overall assembly; this static separation is shown as distance 5. Stated in another way, the minimum distance between a discrete point along the ground conductor's central axis and the central axis of the twisted/wrapped current carrying wires is equal to the minimum distance between any other point on the ground conductor's central axis and the central axis of the twisted/wrapped current carrying wires. The rate of helical rotation of the two groups is at a rate less than or different than the internal twist rate of the current carrying wire group, otherwise all wires would be running in parallel and the distance from each current carrying wire to the ground wire would not average or equalize with each twist cycle of the current carrying wires. A helical twist rate of zero is shown in FIG. 1 and FIGS. 4-6, while a helical twist rate exceeding zero but less than the twist rate of the current carrying wires is shown in FIGS. 7-9.

FIG. 4B depicts an end view of this preferred embodiment of the power cable with two current carrying wires and one ground wire. As may be seen the ground G extends straight along the length of the power cable, and the current carrying wires 3 rotate about central axis 1 of the twisted current carrying wires. In FIG. 4B the solid lines of the current carrying wires represent the closest end of the current carrying wires, and the dashed lines 4 represent cross sections taken farther back along the current carrying wires as they twist. The minimum distance 5 between the central axis of the ground wire and the central axis of the current carrying wire groups is shown.

Figure 5A:
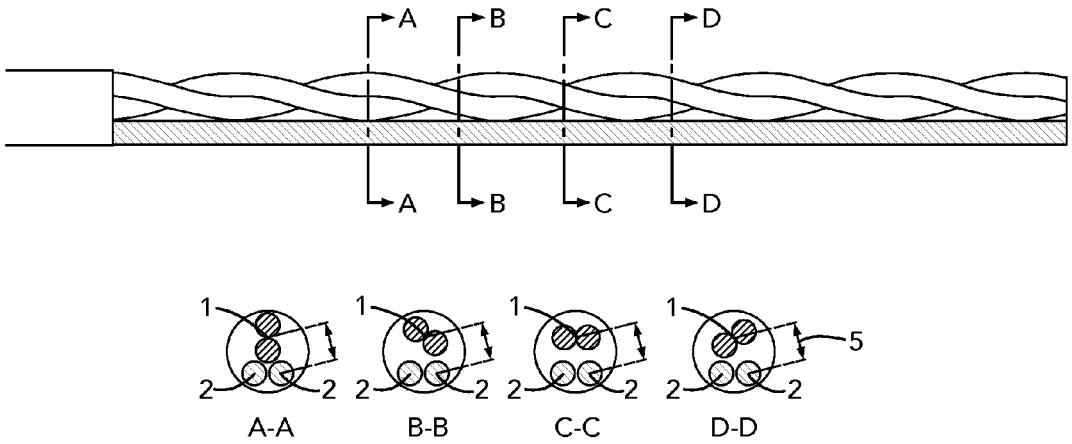
FIG. 5 depicts an alternative embodiment of the improved power cable in a side view and several cross sectional views along cut-lines A-A, B-B, C-C, and D-D (FIG. 5A), an end view relative to the ground wire (FIG. 5B), and a perspective view (FIG. 5C)
Figure 5B:
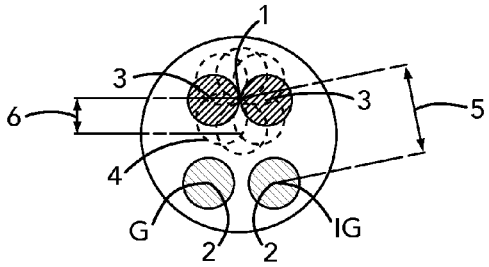
Figure 5C:
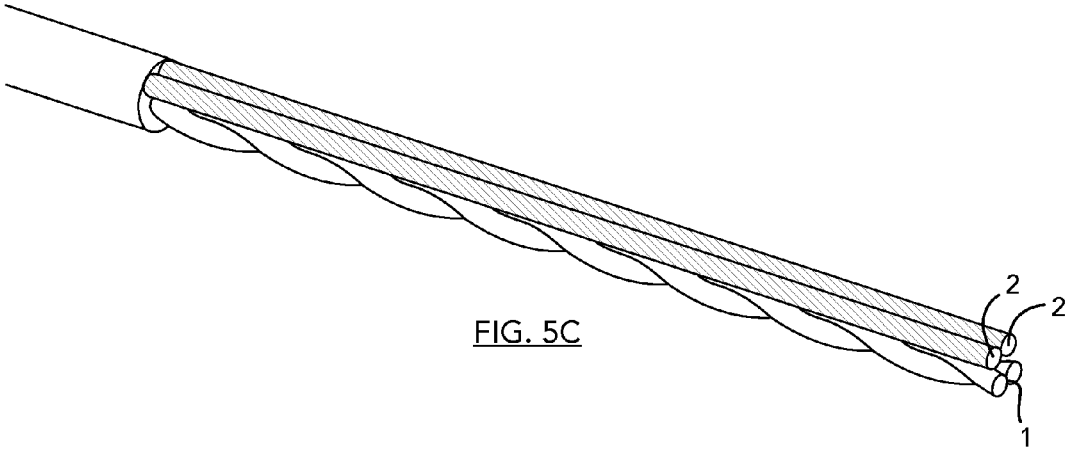

In FIG. 5, an alternative embodiment of the improved power cable with two current carrying wires and two ground wires is shown in a side view and four cross sectional views along cut-planes A-A, B-B, C-C, and D-D (FIG. 5A), an end view enlarged to show detail (FIG. 5B), and a perspective view (FIG. 5C). These are the same views as shown in FIG. 4, but here simply show an alternative embodiment that differs from the above discussed embodiment in that there are two separate and parallel ground wires/conductors.

In FIG. 6, an alternative embodiment of the improved power cable is shown, wherein the improved power cable comprises four current carrying wires and one ground wire.

Figure 6A:
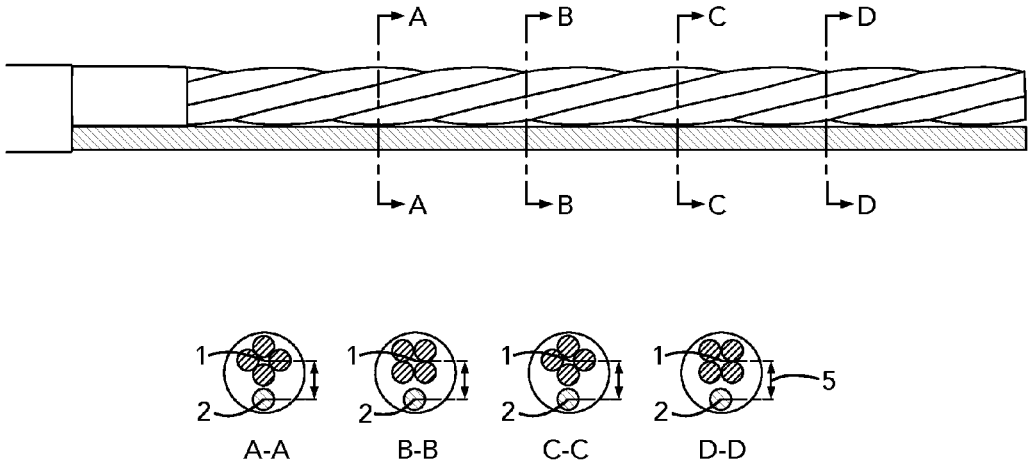
FIG. 6 depicts an alternative embodiment of the improved power cable in a side view and several cross sectional views along cut-lines A-A, B-B, C-C, and D-D (FIG. 6A), an end view relative to the ground wire (FIG. 6B), and a perspective view (FIG. 6C)
Figure 6B:
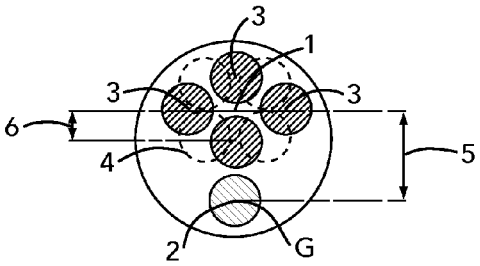
Figure 6C:
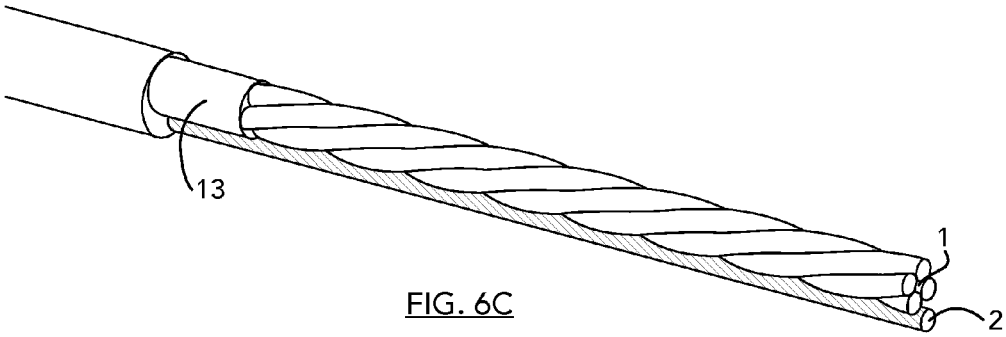

The cable is shown in a side view, and four cross sectional views along cut-planes A-A, B-B, C-C, and D-D (FIG. 6A), an end view enlarged to show detail (FIG. 6B), and a perspective view (FIG. 6C). This embodiment differs from that shown in FIG. 4 in that there are four current carrying wires twisted together instead of two. The embodiment shown in FIG. 6 also differs in that the twisted current carrying wire group has been separately insulated from the remainder of the power cable. The improved power cable according to this alternative embodiment thus comprises an inner insulation layer 13 formed around the twisted current carrying wire group, as depicted in FIG. 6C.

Figure 7A:
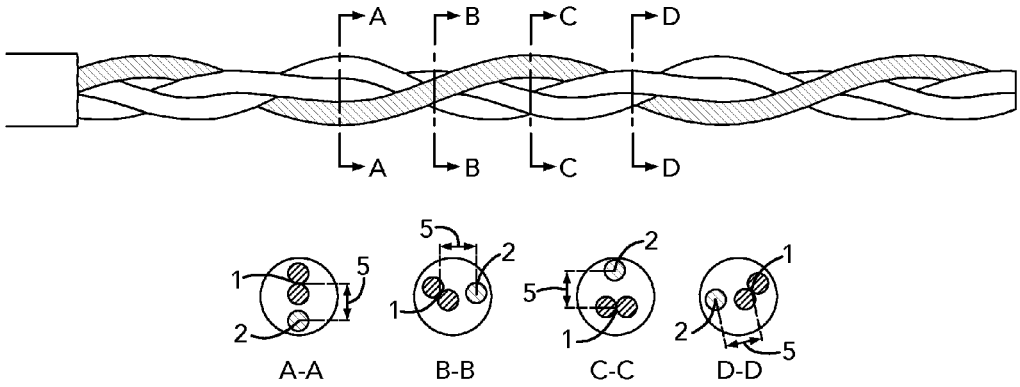
FIG. 7 depicts an alternative embodiment of the improved power cable in a side view and several cross sectional views along cut-lines A-A, B-B, C-C, and D-D (FIG. 7A), an end view relative to the ground wire (FIG. 7B), and a perspective view (FIG. 7C)
Figure 7B:
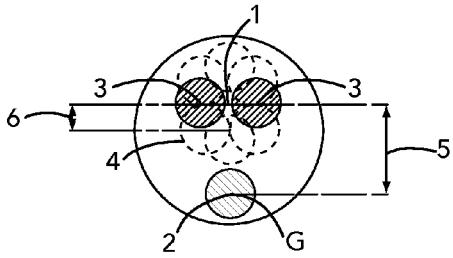
Figure 7C:
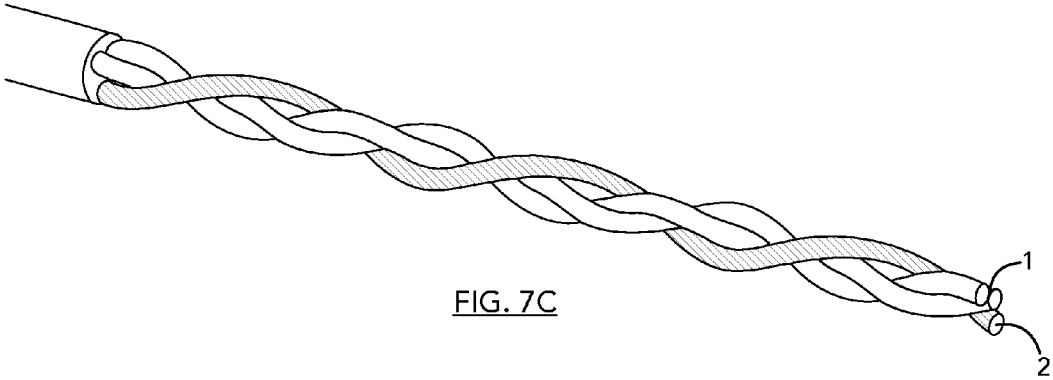

In FIG. 7, an alternative embodiment of the improved power cable is shown, wherein the cable comprises two current carrying wires and one ground wire. FIG. 7 includes a side view and four cross sectional views along cut-planes A-A, B-B, C-C, and D-D (FIG. 7A) an end view enlarged to show detail (FIG. 7B), and a perspective view (FIG. 7C). This embodiment differs from that shown in FIG. 4 in that the separate ground wire/conductor is twisted or helically rotated with the twisted or helically rotated current carrying wire group. The helical rotation of the two groups of wires improves the structural integrity of the power cable for long cable runs that may be installed with long radius sweeps because the helical rotation of the two groups allows the axis of each group to travel approximately the same distance over the cable run; thereby, reducing the strain on the end cable terminations or strain reliefs. The helical rate of rotation may range from zero up to but not including the twist rate of the current carrying wires. The maximum induced voltage remains limited by the length of the twist cycle of the current carrying wires relative to the ground wire. For ease of understanding, the ground conductor/wire in this figure has been shaded in the side and perspective views. Additionally, it is noted that FIG. 7B is shown as a composite of four cross sections similar to FIG. 4B, wherein the four cross sections A-A, B-B, C-C, and D-D, are each rotated to place the ground wire at the bottom of the composite cross section. The composite cross section of FIG. 7B demonstrates the power cable geometry relative to the central axis of the ground wire. FIG. 7B is drawn as such because the geometry and functional advantages of this embodiment are easier to envision when displayed relative to, or with respect to, the central axis of the ground wire as shown in FIG. 4B. In this embodiment the central axis of the ground conductor 2 is still parallel to and uniformly separated from the central axis 1 of the twisted current carrying wires. Stated in another way, the minimum distance between a discrete point along the ground conductor's central axis and the central axis of the twisted/wrapped current carrying wires is equal to the minimum distance between any other point on the ground conductor's central axis and the central axis of the twisted/wrapped current carrying wires.

Figure 8A:
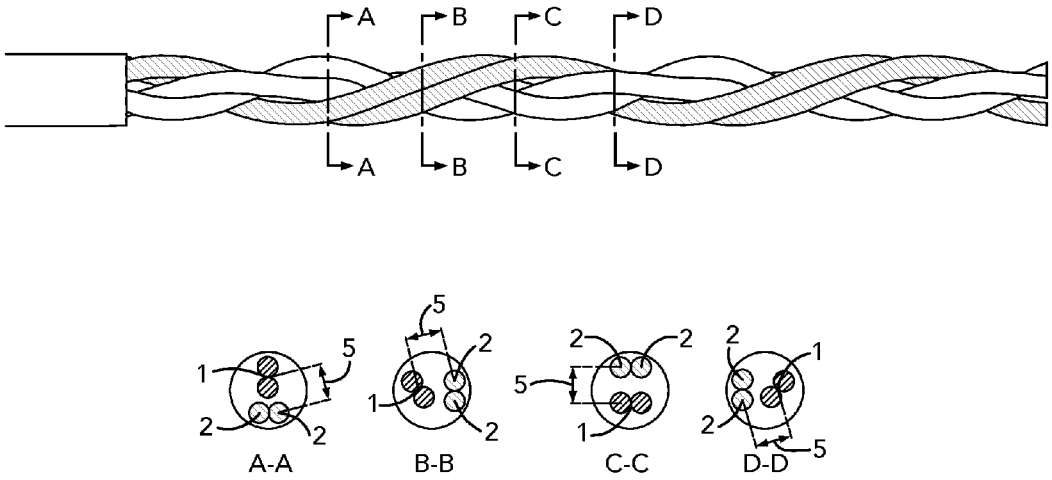
FIG. 8 depicts an alternative embodiment of the improved power cable in a side view and several cross sectional views along cut-lines A-A, B-B, C-C, and D-D (FIG. 8A), an end view relative to the ground wire (FIG. 8B), and a perspective view (FIG. 8C)
Figure 8B:
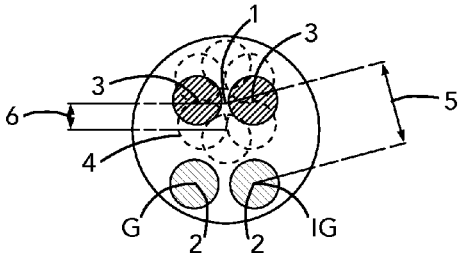
Figure 8C:
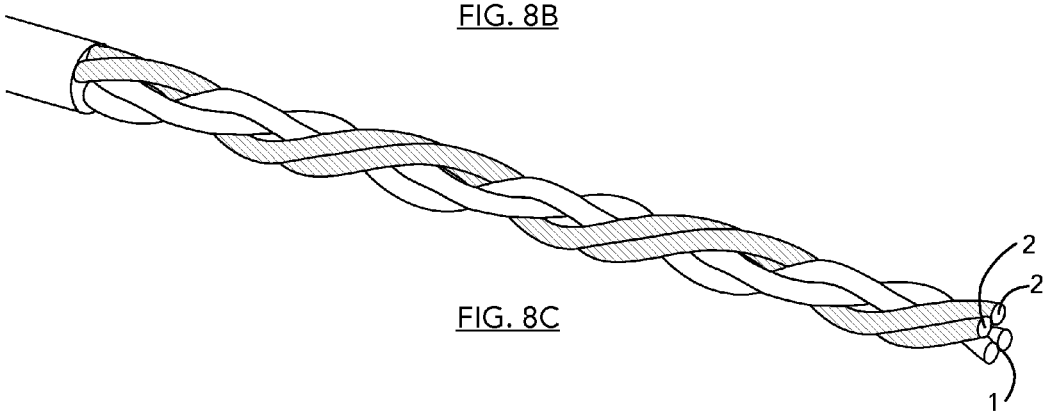

In FIG. 8, an alternative embodiment of the improved power cable is shown in a side view and four cross sectional views along cut-planes A-A, B-B, C-C, and D-D (FIG. 8A) an end view enlarged to show detail (FIG. 8B), and a perspective view (FIG. 8C). This embodiment is similar to the embodiment shown in FIG. 5 in that it comprises two ground wires, however, in this embodiment the two separate ground wires/conductors are twisted or helically rotated with the twisted or helically rotated current carrying wire group. For ease of understanding, the ground conductors/wires have been shaded in the side and perspective views. Additionally, it is noted that FIG. 8B is shown as a composite of four cross sections similar to FIG. 5B, wherein the four cross sections A-A, B-B, C-C, and D-D, are rotated in order to place the ground wires at the bottom of the composite cross section. The composite cross section of FIG. 8B demonstrates the power cable geometry relative to the central axis of the ground wire. FIG. 8B is drawn as such because the geometry is easier to envision when displayed relative to, or with respect to, the central axes of the ground wires as shown in FIG. 5B. In this embodiment the central axis of each ground conductor 2 is still parallel to and uniformly separated from the central axis 1 of the twisted current carrying wires.

Figure 9A:
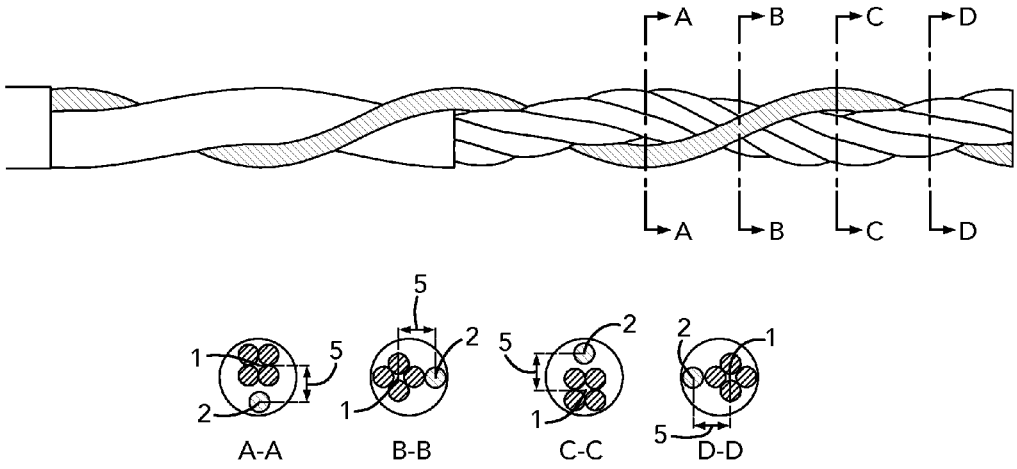
FIG. 9 depicts an alternative embodiment of the improved power cable in a side view and several cross sectional views along cut-lines A-A, B-B, C-C, and D-D (FIG. 9A), an end view relative to the ground wire (FIG. 9B), and a perspective view (FIG. 9C)
Figure 9B:
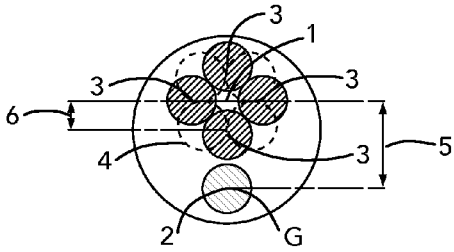
Figure 9C:
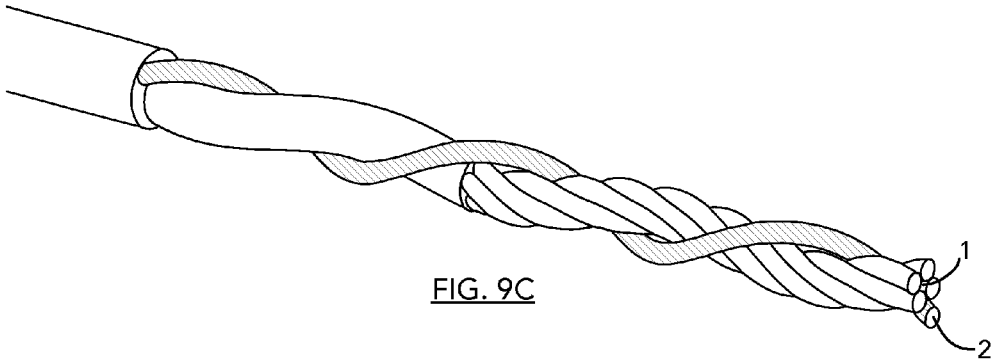

In FIG. 9, an alternative embodiment of the improved power cable is shown in a side view and several cross sectional views along cut-planes A-A, B-B, C-C, and D-D (FIG. 9A) an end view enlarged to show detail (FIG. 9B), and a perspective view (FIG. 9C). This embodiment differs from that shown in FIG. 6 in that the ground wire/conductor is twisted or helically rotated with the twisted current carrying wire group. Additionally, it is noted that FIG. 9B is shown as a composite of four cross sections similar to FIG. 6B, wherein the four cross sections A-A, B-B, C-C, and D-D, are rotated in order to place the ground wire at the bottom of the composite cross section. The composite cross section of FIG. 9B demonstrates the power cable geometry relative to the central axis of the ground wire. FIG. 9 is drawn as such because the geometry is easier to envision when displayed relative to, or with respect to, the central axis of the ground wire as shown in FIG. 6B. In this embodiment the central axis of the ground conductor 2 is still parallel to and uniformly separated from the central axis 1 of the twisted current carrying wires.

Compared to conventional cables, the present invention separates the central axis of the current carrying wire group from the central axis of the ground wire because the ground wire is not twisted within the current carrying group. As a result, minor twist rate construction errors, or geometric offsets and bends due to field installations will have lower negative impacts due to the physical separation between the central axis of the current carrying wire group and the ground conductor. These geometry errors are likely to be negligible when compared with the distance between the two axes; whereas, in conventional power cables, such errors can have dramatic impacts on induced voltage because the two axes converge on the same location. While these attributes serve to benefit the performance of the presently presented power cable, the primary advantage of the power cable is the cycling of induced voltage with each twist cycle of the current carrying wires because there is generally a very high quantity of twist cycles over the length of a typical power cable.

The applicants' power cable comprises assemblies designed to accommodate a variety of equipment rated for utility service voltages from 120 to 600 volts AC. The National Electrical Code defines anything over 600V to be a different category of medium voltage cables. In addition, the National Electrical Code Article 725 defines circuits as "power limited" and "class II" if they are limited to not more than 30 volts and 1000 volt-amperes (i.e. watts). Therefore, wiring manufactured for use under 30 volts is a different class of wiring than wiring utilized for utility power service voltages between 120 and 600 volts AC.

The size of the power cable wires will preferably provide for branch circuit, feeder, or portable power cable ampacities ranging from 15 to 750 amps. The National Electrical Code defines the minimum power branch circuit size at 15 amps. Therefore, the applicants' power cable embodiments are designed for the following:

1. Utility power service voltages between 120 to 600 volts AC rms.

2. Branch circuits and feeders between 15 to 750 amps.

The improved power cable's wires/elongate conductors may be stranded or solid according to industry standards for the construction of electrical wiring. The conductors may be coated with a variety of materials including various types of insulating materials, such as thermoplastic or rubber insulation surrounding each wire 11. The improved power cable may also comprise dielectric fill material 12, lubricating materials 12, and an overall plastic, rubber, or metallic outer sheath 10. These materials provide electrical insulation and protection from external mechanical forces. The improved power cable insulation may be stripped off to allow for mechanical, compression, or soldered terminations. Each end of the power cable may be provided with strain relief connectors and terminations to meet industry standards for terminals and connector plugs, including a wide variety of NEMA and IEC standard plugs, receptacles, and connectors. For example, the invention may include but is not limited to a standard NEMA 15-P plug and IEC C13 connector (as shown in FIG. 1). Another common application is a three-phase NEMA L21-20 power receptacle. The wires within the power cable may be copper or aluminum and other metal alloys with similar characteristics. The outer protective sheath or armor may comprise plastic, rubber, steel, aluminum, or other insulating products/materials with similar characteristics.

In a preferred embodiment, the present invention comprises one line conductor, one line or neutral return conductor, and a ground conductor, arranged as disclosed above. Alternative embodiments of the present invention include three or four current carrying wires and optionally an isolated second ground conductor.

The term "ground conductor" may be replaced with the term "ground conductors" when two ground conductors are required. The two ground conductors are typically referred to as the "equipment ground" and the "isolated ground" conductor.

The term conductor or wire may represent stranded or solid conductor assemblies.

When compared to conventional power cables that contain current carrying wires and ground wires in parallel or twisted at the same rate around a single central axis, the present invention provides a central axis dedicated to the current carrying wires. The ground wire is not twisted within the group of current carrying wires. The ground wire is located adjacent to and runs approximately equidistant or parallel with the central axis of the current carrying wire group. This cable geometry averages the distance from the midpoint of the ground wire to the midpoint of each current carrying wire over each twist cycle of the current carrying wire group.

The improved power cable with twisted current carrying wires may be used for fixed building premise wiring, or for portable power cables to connect portable electronic pieces of equipment. A list of applicable devices includes but is not limited to:

1. Permanently installed building power distribution cables, including power feeders and branch circuits.
2. Temporary installed power distribution cables, including power feeders and branch circuits.
3. Power cables and extension cords for portable equipment.

In one specific embodiment of use, group loop potential in a power cable may be reduced by twisting a plurality of insulated line and neutral wires into a first twisted group having a first central axis located at the cross-sectional center of the first twisted group and a first pitch length, separating said first twisted group central axis to a constant distance from an insulated ground wire central axis, twisting the first twisted group with the ground wire, forming an equal pitch of said first central axis and ground wire central axis such that when the power cable is energized the net magnitude and direction of the magnetic flux experienced by said ground conductor loop over the length of said power cable is averaged, where the net magnetic flux experienced by said ground conductor loop over the length of said power cable is averaged to less than the maximum magnitude and direction of the net magnetic flux from one pitch length of the first twisted group. The first twisted group may be said to have a first twist rate, and the first twisted group may be twisted with the ground conductor at a second rate less than the first rate. Finally, a fixed distance may be maintained between a central axis of the ground conductor and a central axis of the first twisted group.

The improved power cable for reducing the accumulation of magnetically induced voltages on at least one ground wire, may be described to comprise at least two current carrying conductors twisted around a first axis, at least one ground conductor having a ground cross-sectional central axis, wherein said ground cross-sectional central axis is a fixed distance from said first axis at all cross sectional planes throughout the length of the power cable, and wherein said ground cross-sectional central axis and said first axis have equal pitch. The first axis and the ground cross-sectional central axis may be described as twisted around a second axis, and the second axis may be described as located at the cross-sectional center of volume of the power cable. The at least two current carrying conductors may be described as twisted together around the first axis at a first twist rate, and the first axis and the ground cross-sectional central axis may be described as twisted around a second axis at a second twist rate. In some embodiments the first twist rate is greater than said second twist rate. In some embodiments the first twist rate pitch is between 2 and 2,000 times the outer diameter of a current carrying wire, wherein the current carrying wires and at least one ground wire gauge is at least #16 AWG.

The improved power cable may further be described as comprising a first group of helically wrapped elongate conductors, the first group comprising at least two elongate current carrying conductors and a first central axis, a second group comprising at least one elongate ground conductor at a fixed distance from said first group of helically wrapped elongate conductors, wherein the first group central axis and second group have equal pitch. The first group of helically twisted elongate conductors may be described to have a first pitch from the frame of reference of the at least one elongate ground conductor and the cable length of at least one first pitch, wherein within each first pitch of said cable, for each at least one elongate ground conductor, the average minimum distance between a central axis of said elongate ground conductor and a central axis of any one of said twisted elongate conductors is equal to the average minimum distance between the central axis of said elongate ground conductor and the central axis of every other twisted elongate conductor. Further, each at least one elongate ground conductor may be described as helically twisted with said first group around a helical central axis at a second pitch from the frame of reference of the helical central axis, where the second pitch is greater than the first pitch.

In this description the first group of helically twisted elongate conductors may have a first pitch relative to the at least one elongate ground conductor, and each at least one elongate ground conductor may be helically twisted with the group of helically twisted elongate conductors at a second pitch relative to the power cable central axis, where the second pitch is greater than said first pitch. Further, the first pitch may be between 2 and 2000 times the outer diameter of each of the helically twisted elongate conductors, wherein the current carrying wires and at least one ground wire gauge is at least #16 AWG. Finally, the first group of helically twisted elongate conductors may have a first central axis, each of the elongate ground conductors may comprise a ground conductor central axis, and the minimum cross section distance between any discrete point along said ground conductor central axis and said first central axis is equal to the minimum distance between any other discrete point along said ground conductor central axis and said first central axis.

The improved power cable may also be described as comprising a twisted current carrying wire group comprising at least two insulated current carrying wires and having a current carrying wire group central axis located at the cross-sectional center of the twisted current carrying wire group, at least one insulated ground wire having a ground wire central axis located at the cross-sectional center of the ground wire wherein the ground wire central axis is aligned at a fixed distance from the current carrying wire group central axis, where the at least one ground wire is separate from the twisted current carrying wire group, and where the current carrying wire group central axis and ground wire central axis have equal pitch. The current carrying wire group central axis and ground wire central axis may be described to helically rotate around a common axis. The twisted current carrying wire group may comprise any combination of line and neutral conductors. The twisted current carrying wire group may be described as having a first twist rate with respect to the current carrying wire group central axis, while the twisted current carrying wire group and the at least one ground wire may be said to helically rotated around each other at a second twist rate with respect to the helical central axis, where the first twist rate is greater than the second twist rate.

Each current carrying wire may comprise a current carrying wire central axis located at the cross-sectional center of each current carrying wire, where the distance from each current carrying wire central axis to the ground wire central axis cycles periodically with each twist cycle of the at least two current carrying wires relative to the ground wire central axis. The twisted current carrying wire group may be twisted at least one complete twist cycle with respect to said ground wire central axis over the length of the power cable. The magnetically induced voltage on the at least one ground wire may have a magnitude that cycles with the length of each twist cycle of the twisted current carrying wire group relative to the ground wire central axis. The twisted current carrying wire group may have a current carrying wire twist rate relative to said ground wire central axis and the current carrying wire group central axis and the at least one ground wire central axis may be helically rotated around a helical central axis at a twist rate relative to the helical central axis less than the twisted current carrying wire group twist rate. The twisted current carrying wire group and the at least one ground wire may be helically rotated around the helical central axis, and in a given length of power cable the number of twists of the twisted current carrying wire group may exceed the number of rotations of the twisted current carrying wire group and the at least one ground wire around the helical central axis. Finally, each of the at least two current carrying wires may be said to have a current carrying wire outer diameter at least as large as the ground wire outer diameter, and the at least one ground wire may be separated from the central axis of the twisted current carrying wire group by a distance greater than said outer diameter.

With respect to the above description then, it is to be realized that material disclosed in the applicants' drawings and description may be modified in certain ways while still producing the same result claimed by the applicants. Such variations are deemed readily apparent and obvious to one skilled in the art, and all equivalent relationships to those illustrated in the drawings and equations and described in the specification are intended to be encompassed by the present invention.

The foregoing is considered as illustrative only of the principles of the invention. Furthermore, because numerous modifications and changes will readily occur to those skilled in the art, it is not desired to limit the invention to the exact disclosure shown and described, and accordingly, all suitable modifications and equivalents should be considered part of the presented patent, and falling within the scope of the invention.

We claim:

1. A power cable for reducing the accumulation of magnetically induced voltages on at least one ground wire, the power cable comprising:

a. a single twisted current carrying wire group comprising at least two insulated current carrying wires and having a current carrying wire group central axis located at the cross-sectional rotation axis of the twisted current carrying wire group;

b. at least one insulated ground wire having a ground wire central axis located at the cross-sectional center of the ground wire wherein said ground wire central axis is aligned at a fixed distance greater than zero from the current carrying wire group central axis;

c. wherein the at least one ground wire is separate from the twisted current carrying wire group;

d. wherein said current carrying wire group central axis and ground wire central axis have equal pitch; and e. wherein said pitch is greater than zero.

2. The power cable of claim 1 wherein said current carrying wire group central axis and ground wire central axis helically rotate around a common axis.

3. The power cable of claim 2 wherein:

a. the twisted current carrying wire group has a first twist rate with respect to the current carrying wire group central axis;

b. the twisted current carrying wire group and the at least one ground wire are helically rotated around each other at a second twist rate with respect to the common central axis;

c. the first twist rate is greater than the second twist rate; and d. the second twist rate is greater than zero.

4. The power cable of claim 2 wherein:

a. the twisted current carrying wire group has a current carrying wire twist rate relative to said ground wire central axis;

b. the current carrying wire group central axis and the at least one ground wire central axis are helically rotated around a common central axis at a twist rate relative to the common central axis less than the twisted current carrying wire group twist rate;

c. the twist rate around the common central axis is greater than zero; and d. the twist rate around the common central axis results in a complete twist cycle, or pitch, over the length of the power cable.

5. The power cable of claim 2 wherein:

a. the twisted current carrying wire group and the at least one ground wire are helically rotated around the common central axis; and b. in a given length of power cable the number of twists of the twisted current carrying wire group exceeds the number of rotations of the twisted current carrying wire group and the at least one ground wire around the common central axis.

6. The power cable of claim 1 wherein the twisted current carrying wire group comprises any combination of line and neutral conductors.

7. The power cable of claim 1 wherein:

a. each current carrying wire comprises a current carrying wire central axis located at the cross-sectional center of each current carrying wire; and b. wherein the distance from each current carrying wire central axis to said ground wire central axis cycles periodically with each twist cycle of the at least two current carrying wires relative to the ground wire central axis.

8. The power cable of claim 1 wherein:

a. the twisted current carrying wire group is twisted at least one complete twist cycle with respect to said ground wire central axis over the length of the power cable.

9. The power cable of claim 1 wherein:

a. the magnetically induced voltage on the at least one ground wire has a magnitude that cycles with the length of each twist cycle of the twisted current carrying wire group relative to the ground wire central axis.

10. The power cable of claim 1 wherein:

a. each of the at least two current carrying wires have an outer diameter; and b. the twisted current carrying wire group has a pitch between 2 and 2000 times the outer diameter.

11. The power cable of claim 1 wherein a. the power cable conductors are coated with insulation; and b. the insulation thickness and material is configured for utility service voltages between 120 and 600 V AC rms.

12. The power cable of claim 1 wherein:

a. the at least two current carrying wires have an ampacity rating based on the wire gauge;

b. wherein the current carrying wires and at least one ground wire gauge is at least #16 AWG; and c. the ampacity rating is at least 15 and no more than 750 amps.

13. The power cable of claim 1 wherein:

a. the at least one ground wire has a ground wire outer diameter;

b. each of the at least two current carrying wires have a current carrying wire outer diameter at least as large as said ground wire outer diameter; and c. the at least one ground wire is separated from the central axis of the twisted current carrying wire group by a distance greater than said ground wire outer diameter.

14. A power cable for reducing the accumulation of magnetically induced voltages on at least one ground wire, the power cable comprising:

a. at least two current carrying conductors twisted around a single first axis;

b. at least one insulated ground conductor having a ground cross-sectional central axis;

c. wherein said ground cross-sectional central axis is a fixed distance from said first axis at all cross sectional planes throughout the length of the power cable;

d. wherein said ground cross-sectional central axis and said first axis have equal pitch; and e. wherein said pitch is greater than zero.

15. The power cable of claim 14 wherein:

a. said first axis and said ground cross-sectional central axis are twisted around a second axis.

16. The power cable claim 15 wherein:

a. said second axis is located at the cross-sectional center of volume of said power cable.

17. The power cable of claim 14 wherein:

a. said at least two current carrying conductors are twisted together around said first axis at a first twist rate; and b. said first axis and said ground cross-sectional central axis are twisted around a second axis at a second twist rate.

18. The power cable of claim 17 wherein:

a. said first twist rate is greater than said second twist rate.

19. The power cable of claim 17 wherein:

a. each of the at least two current carrying wires have an outer diameter;

b. said first twist rate pitch is between 2 and 2,000 times the outer diameter; and c. wherein the current carrying wires and at least one ground wire gauge is at least #16 AWG.

20. An electrical power cable comprising:

a. a single first group of helically wrapped elongate conductors, the first group comprising at least two elongate current carrying conductors and a first rotation axis;

b. a second group comprising at least one elongate ground conductor at a fixed distance from said first group of helically wrapped elongate conductors;

c. wherein the first group rotation axis and second group have equal pitch; and d. wherein said pitch is greater than zero.

21. The electrical power cable of claim 20 wherein:

a. said first group of helically twisted elongate conductors has a first pitch from the frame of reference of the at least one elongate ground conductor;

b. said cable has cable length of at least one first pitch; and c. within each first pitch of said cable, for each at least one elongate ground conductor, the average minimum distance between a central axis of said elongate ground conductor and a central axis of any one of said twisted elongate conductors is equal to the average minimum distance between the central axis of said elongate ground conductor and the central axis of every other twisted elongate conductor.

22. The electrical power cable of claim 21 wherein:

a. each at least one elongate ground conductor is helically twisted with said first group around a common central axis at a second pitch from the frame of reference of the common central axis; and b. said second pitch is greater than said first pitch.

23. The electrical power cable of claim 22 wherein:

a. each of the helically twisted elongate conductors has an outer diameter;

b. wherein the first pitch is between 2 and 2,000 times the outer diameter; and c. wherein the wire gauge size is at least #16 AWG.

24. The electrical power cable of claim 20 wherein:

a. said first group of helically twisted elongate conductors has a first pitch relative to the at least one elongate ground conductor;

b. each at least one elongate ground conductor is helically twisted with said group of helically twisted elongate conductors at a second pitch relative to the power cable central axis;

c. said second pitch is greater than said first pitch; and d. said pitch is greater than zero.

25. The electrical power cable of claim 24 wherein:

a. each of the helically twisted elongate conductors has an outer diameter;

b. the first pitch is between 2 and 2,000 times the outer diameter; and c. wherein the current carrying wires and at least one ground wire gauge is at least #16 AWG.

26. The electrical power cable of claim 20 wherein:

a. said first group of helically twisted elongate conductors has a first central axis;

b. each at least one elongate ground conductor has a ground conductor central axis; and c. wherein the minimum cross section distance between any discrete point along said ground conductor central axis and said first central axis is equal to the minimum distance between any other discrete point along said ground conductor central axis and said first central axis.

27. A method for reducing group loop potential in a power cable, the method comprising the steps of:

a. twisting a plurality of insulated line and neutral wires into a first twisted group having a first central axis located at the cross-sectional center of the first twisted group and a first pitch length;

b. separating said first twisted group central axis to a constant distance from an insulated ground wire central axis;

c. twisting said first twisted group with said ground wire;

d. forming an equal pitch of said first central axis and ground wire central axis such that when the power cable is energized the net magnitude and direction of the magnetic flux experienced by said ground conductor loop over the length of said power cable is averaged; and e. the net magnetic flux experienced by said ground conductor loop over the length of said power cable is averaged to less than the maximum magnitude and direction of the net magnetic flux from one pitch length of the first twisted group.

28. The method according to claim 27 further comprising:

a. twisting said first twisted group at a first twist rate;

b. twisting said first twisted group and said ground conductor at a second rate less than said first rate; and c. the second rate is greater than zero.

29. The method for reducing ground loop potential in a power cable of claim 27 further comprising maintaining a fixed distance between a central axis of said ground conductor and a central axis of said first twisted group.

* * * * *